United States Patent [19]

Serras-Paulet

[11] 4,400,594

[45] Aug. 23, 1983

[54] CONTROL KEYBOARD FOR ELECTRIC OR ELECTRONIC DEVICES

[76] Inventor: Edouard Serras-Paulet, Casa Nostra Pech des Treilles, Puylaroque, France, 82240

[21] Appl. No.: 213,999

[22] PCT Filed: Nov. 28, 1979

[86] PCT No.: PCT/FR79/00113

§ 371 Date: Jul. 22, 1980

§ 102(e) Date: Jul. 22, 1980

[87] PCT Pub. No.: WO80/01218

PCT Pub. Date: Jun. 12, 1980

[30] Foreign Application Priority Data

Nov. 29, 1978 [FR] France ..... 78 33733

[51] Int. Cl.[3] ..... H01H 5/02; H01H 13/00

[52] U.S. Cl. ..... 200/5 A; 200/67 F; 200/159 B; 335/206

[58] Field of Search ..... 200/5 R, 5 A, 61.1, 200/61.11, 86 R, 159 B, 328, 67 F; 335/205, 206, 207

[56] References Cited

U.S. PATENT DOCUMENTS

| | | | |
|---|---|---|---|
| 3,448,419 | 6/1969 | Myatt | 335/206 |
| 3,693,123 | 9/1972 | Pedersen | 335/206 |
| 3,736,397 | 5/1973 | Pedersen | 200/328 |
| 3,761,016 | 9/1973 | Pedersen | 335/206 |
| 3,879,602 | 4/1975 | Walker | 335/205 X |
| 3,916,360 | 10/1975 | Pedersen et al. | 335/205 |
| 3,978,297 | 8/1976 | Lynn et al. | 200/86 R X |
| 4,124,787 | 11/1978 | Aamoth et al. | 200/6 A |
| 4,203,013 | 5/1980 | Serras-Paulet | 335/206 X |
| 4,211,991 | 7/1980 | Lombard et al. | 200/67 F X |
| 4,354,081 | 10/1982 | Serras-Paulet | 200/159 B X |

FOREIGN PATENT DOCUMENTS

| | | |
|---|---|---|
| 2647922 | 5/1977 | Fed. Rep. of Germany . |
| 2395546 | 1/1979 | France . |
| 926353 | 12/1958 | United Kingdom . |
| 1469800 | 4/1977 | United Kingdom . |

*Primary Examiner*—J. R. Scott

*Attorney, Agent, or Firm*—Kane, Dalsimer, Kane, Sullivan and Kurucz

[57] ABSTRACT

A keyboard for electric or electronic devices including a layered composite plate formed with holes through which extend the stems of keys each adapted for controlling one or several electric contacts. The contacts are closed when the corresponding key is in one of its working and rest positions and is open when the key is in its other position. The plate provides for returning the keys by magnetic attraction in cooperation with elements such as soft iron plates or washers rigidly connected to the lower ends of the key stems. The elements are disposed under the plate and are normally maintained in contact with the latter by magnetic attraction thereby determining the rest positions of the keys. The contacts which are controlled by the keys are at least carried by one of the faces of the composite plate and cooperate with closing or opening operating structure associated with the aforementioned keys.

9 Claims, 5 Drawing Figures

CONTROL KEYBOARD FOR ELECTRIC OR ELECTRONIC DEVICES

BACKGROUND OF THE INVENTION

1. Field of the Invention

The invention relates in general to a control keyboard of an electric or electronic device, of the type comprising a grid or an apertured plate formed with a multiplicity of holes in which are engaged keys each adapted for controlling one or several electric contacts when they are depressed.

2. Description of the Prior Art

In the present technology, the keys are generally returned to their rest position by springs. The use of springs leads to many disadvantages: loss of rigidity of the spring, fatigue phenomenon, resonance frequency, bad behaviour to vibrations and accelerations, sensitivity to corrosion, rebound phenomenon when establishing the electric contacts, etc.

It has already been proposed to remove most of said disadvantages by replacing the return springs with magnetic return means which are in part carried by the keys themselves, and in part carried or formed by the aforementioned grid or apertured plate.

This new technique, while presenting many advantages relative to the traditional art, has nevertheless a disadvantage in that the contacts, which are adapted to be acted upon by the keys when the latter are depressed, are carried by an independent plate, generally a printed circuit plate, which is placed under the grid or apertured plate. Thus, a keyboard is composed of three kinds of elements: the keys, the grid or apertured plate, and the printed circuit plate carrying the contact or switching elements associated with the keys. The mounting of such a keyboard has to be relatively accurate since the printed circuit plate carrying the contact elements has to be disposed under the grid at a predetermined distance from the latter.

A further disadvantage of the known prior art techniques is that the duration of the electrical signal corresponding to the closing of a contact obtained by depressing a key is very short relative to the total operation time of the key. However, for some technical reasons, and notably the electronic processing of said signals, it is often required that the duration of the signal thus established be at least equal to 60% of the operation time of the key.

SUMMARY OF THE INVENTION

The object of the present invention is precisely to solve all said problems, by simultaneously avoiding the disadvantages of the known prior art techniques.

Notably, the object of the invention is a monolithic-type keyboard in which the grid carrying the keys and the plate carrying the contact elements are united in one single assembly.

Another object of the invention is an improved keyboard of the aforementioned type, in which the duration of a signal obtained by depressing a key is widely superior to 60% of the total operation time of the key, and is some cases equal to this total operation time.

Therefore, the invention proposes a control keyboard for electric or electronic devices, comprising a grid or a composite plate formed with holes through which extend the stems of keys. Each key is adapted to control one or several electric contacts which are closed when the corresponding key is in one of its working and rest positions and which are open when the key is its other position, said plate or grid comprises means for returning the keys by magnetic attraction by cooperating with elements such as soft iron plates or washers rigidly connected to the lower ends of the key stems. The elements are disposed under said plate and are normally maintained in contact with the latter by magnetic attraction, thereby determining the rest positions of the keys, wherein the contacts which are controlled by the keys are at least partly carried by one of the faces of the composite plate and cooperate with closing or opening operating means associated with the keys.

According to this characteristic of the invention, a monolithic keyboard is obtained in which the grid supporting the keys and the plate supporting the contact elements are united in one single element.

According to a further characteristic of the invention, the contacts are normally closed when the keys are in their rest position, and are open as soon as the keys leave their rest position.

Thus, a keyboard is obtained wherein the duration of a signal resulting from depression of a key is equal to the total operation time of the key, that is the sum of the depressing time of they key and the time needed by it for returning to its rest position.

BRIEF DESCRIPTION OF THE DRAWINGS

The invention will be better understood, and further objects, characterizing features, details and advantages thereof will appear more clearly when reading the following explanatory description with reference to the accompanying diagrammatic drawings given by way of nonlimiting examples only and illustrating various embodiments of the invention, drawings wherein.

DESCRIPTION OF THE PREFERRED EMBODIMENTS

Figure 1:
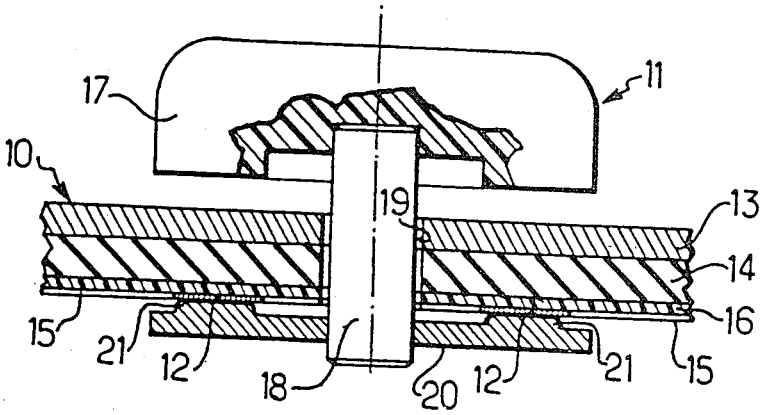
FIG. 1 is a cross-sectional diagrammatic view of a first embodiment of a keyboard according to the invention, with contacts normally closed in the rest position.

FIG. 1 is a partial sectional diagrammatic view of a first embodiment of a keyboard according to the invention. Said keyboard comprises substantially an apertured composite plate 10, keys 11 engaged in the holes of the plate or grid 10, and contact elements 12 mounted on the lower face of the composite plate 10.

Plate 10 can form the front face or a portion of the front face of an electric or an electronic apparatus, and it is associated with a plurality of keys 11 although one only of said keys has been shown in the drawing.

The composite plate 10 comprises an upper metallic plate 13, of small thickness, intended for providing the plate 10 with a sufficient rigidity. On the lower face of the metallic plate 13, made for example of iron, soft iron or steel, is glued or bonded a plate 14 made of a magnetic material such as a multipolar magnetic elastomer, the thickness of which is a function of the magnetic attraction or return force desired for application to said keys.

The contact elements 12 are, for example, metallic or metallized contact wafers, made of an electro-conductive material, and which are part of an electro-conductive network 15 formed on the lower face of a film or thin sheet 16 of insulating material, such as a plastics material. Said film or said thin sheet 16 is fixed, by any appropriate means, on the lower face of the magnetic elastomer plate 14.

Advantageously, the film or thin sheet 16 provided on one face with the electro-conductive network 15 and the contact wafers 12, can be a sheet a flexible plastics material, such as that which is available on the market under the trade-name of "Mylar," which can be used for making a printed circuit, either on depositing on one face of said sheet an electro-conductive ink by a silk-screen process, or by metallizing said face when processing it in a traditional way.

Of course, the electro-conductive network 15 is coated, with the exception of the wafers 12, with a film or a very thin layer of insulating material, for example an insulating varnish.

Each key 11 comprises a head or hood 17, which is mounted, for instance by a resilient snap-in arrangement, on the upper end of a stem 18 which extends inside one of the holes 19 formed in the composite plate 10. At its lower end, the stem 18 is rigidily connected, for example through a snap-in arrangement, ultrasound riveting or any other appropriate means, to a plate or thin washer 20, for example made of soft iron or any other material likely to be magnetically attracted by the magnetic elastomer plate 14.

The contact wafers 12 formed on the thin sheet 16 are arranged in the immediate vicinity of the holes 19, and corresponding bosses or protruding studs 21 are formed on the corresponding or registering surface of the plate or washer 20.

The keyboard operates in the following manner:

In its rest position, each key 11 is in the position shown in FIG. 1, in which the soft iron plate or washer 20, which is rigid with the stem 18, is magnetically attracted by the magnetic elastomer plate 14, being thus applied on the lower face of the thin sheet 16. In this position, the bosses or studs 21 of the plate or washer 20 bear directly on the contact wafers 12 and establish an electric connexion therebetween. The contacts are therefore normally closed, in the rest positions of the keys 11.

When a user depresses a key 11 by applying a force which is superior to the magnetic attraction force exerted by the elastomer plate 14 on the soft iron washer 20, the key 11 is depressed until the lower edge of its head 17 comes in abutment against the upper metallic plate 13. The magnetic attraction force which acts on the plate or washer 20 decreases in proportion with the driving-in of the key, on the whole length of the key stroke. This stroke is relatively small, for example of the order of about 3 mm, so that the magnetic attraction force exerted by the elastomer plate 14 on the washer 20 is always far superior to the total weight of the key 11.

As soon as the key 11 leaves its rest position shown in FIG. 1, the studs or bosses 21 draw away from the contact wafers 12. The resistance of the circuit between two associated wafers 12 then becomes infinite and remains at an infinite value as long as the key 11 is not back to its rest position shown in FIG. 1.

It will be understood that, in this way, the duration of the signal obtained by depressing the key 11 is equal to the total operation time of the key 11 that it requires to be depressed and returned to its rest position. In fact, the signal corresponds to the opening of contacts 12–21, which are closed when the key is its rest position.

It is also noted that the quality of a signal obtained by depressing the key 17 is absolutely independent of the quality of the contact between the wafers 12 and the studs 21, or of the corresponding contact resistance value, since the establishment of said signal by depressing the key 11 corresponds to a contact resistance of infinite value.

In this way, all the rebound phenomena which could eventually appear previously at the moment of the establishment of the signal by closing two contacts are also suppressed.

In explanation, it will be stated, by way of a non limitative example, that the upper metallic plate 13 is a plate of soft iron or steel with a thickness varying between 0.5 and 1.5 mm that the plate 14 is a multipolar magnetic elastomer plate having a thickness comprised between 1 to 2 mm according to the magnetic attraction force which one wishes to obtain, that the thin sheet 16 provided with the electro-conductive network 15 and the contact wafers 12 has a thickness of about 1 tenth of a mm, the soft iron plate or washer 20 has a thickness of 1 mm, the contact wafers 12 have a diameter of 5 mm about, the stroke of the key 11 is of 3 mm about, the magnetic attraction force applied by the plate 14 on the soft iron plate 20 varies between 40 and 150 g depending on whether the thickness of plate 14 varies between 1 and 2 mm.

In all cases, the magnetic attraction force exerted by the elastomeric plate 14 on the washer 20 is far superior to the total weight of the key 11 and resists accelerations well over 10 g.

Figure 2:
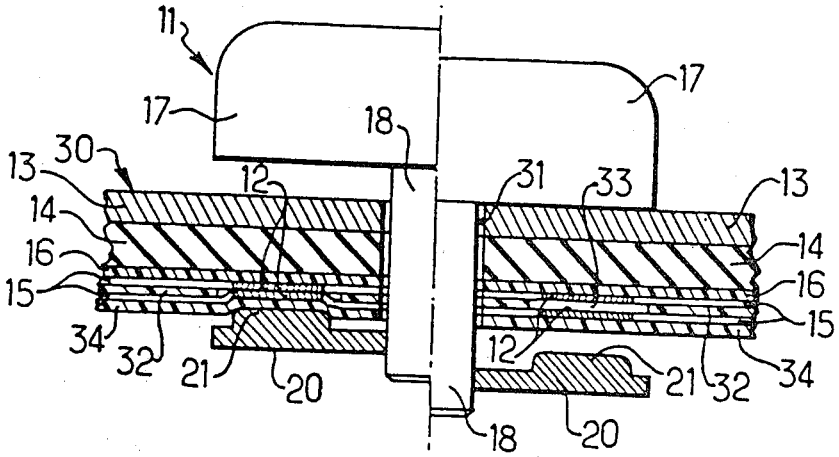
FIG. 2 is a cross-sectional diagrammatic view of a second embodiment of a keyboard according to the invention, with tight contacts normally closed in the rest position.

FIG. 2 illustrates an alternative embodiment of the keyboard of the invention, which differs from the embodiment of FIG. 1 in that the contacts controlled by the keys 11 are completely tight.

The left-hand side half-view of FIG. 2 shows the key in its rest position, and the right-hand half-view shows the key in its working position or at the end of its stroke.

This embodiment of FIG. 2 comprises, as the previous one, a key 11 having a head 17 mounted by any appropriate means, for example by a resilient snap-in arrangement, on the upper end of a stem 18 extending freely through a hole 31 of a composite grid or apertured plate 30. The lower end of the key is rigidly connected to a plate or washer 20, for example of soft iron, placed under the composite plate 30 and comprising on its upper face studs or bosses 21.

The composite plate 30 comprises an upper metallic plate 13, a plate 14 made for example of a multipolar magnetic elastomer, and a thin sheet 16 of insulating material the lower face of which is provided with an electro-conductive network 15 and contact wafers 12, as in the embodiment of FIG. 1.

Figure 3:
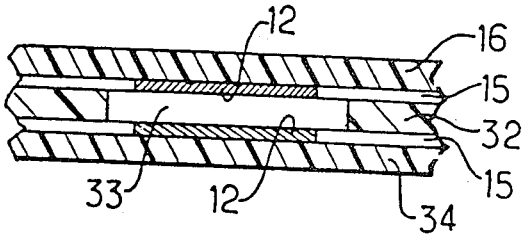
FIG. 3 is a sectional view at a larger scale of a contact element used in the keyboard shown in FIG. 2.

Contrary to the embodiment of FIG. 1, and as is best seen in FIG. 3, another insulating material thin sheet 32 is fixed on the lower face of the thin sheet 16 and on the electro-conductive network 15. This thin sheet 32 may also be made of "Mylar" as the thin sheet 16, and it has substantially the same thickness (for example 0.1 mm).

The thin sheet 32 is cut out, as is shown at 33, at the level of the contact wafers 12 of the first thin sheet 16.

On the lower face of said thin sheet 32 is applied another thin sheet 34, for example identical to the first thin sheet 16, and the upper face of which carries also an electro-conductive network 15 and contact wafers 12. The thin sheets 16, 32, 34 are superimposed so that the contact wafers 12 of two sheets are in register with each other, at the level of the cut-outs 33 of the intermediate sheet 32. These three sheets may be fixed to each other in any appropriate way, for example by gluing, ultrasound welding, etc.

Since the thin lower sheet 34 is made of a flexible plastics material, one needs only to apply a very light pressure in the upper direction on said sheet, on the level of wafer 12, to deform it and bring the wafer 12 of the lower sheet 34 in contact with the wafer 12 of the upper sheet 16. When the sheets 16 and 34 are in "Mylar" and have a thickness of 0.1 mm about, it has been established that a force of 5 g exerted on a sheet 16 or 34 ensures the contact of the two wafers 12.

The embodiment of the keyboard of the invention which is shown in FIG. 2 operates in the following manner:

When the key 11 is in its rest position (left-hand side half-view), the studs or bosses 21 of the washer 20 bear against the lower sheet 34, at the level of the wafers 12, with a force which is well over the force of 5 g which is necessary for bringing in contact the wafers 12 of sheet 34 and 16. When the two wafers 12, which are in register, are in contact with each other, the corresponding contact which is adapted to be controlled by the key 11 is closed. One needs only to apply on the key 11 a force for depressing the key which exceeds the magnetic attraction force exerted by the elastomer plate 14 on the washer 20. As soon as the key 11 leaves its rest position, the bosses or studs 21 stop exerting a pressure on the lower thin sheet 34, and said sheet, due to its resiliency, resumes its normal position which is shown in the right-hand side half-view of FIG. 2, or in FIG. 3. The wafers 12 in register with each other are then separated and the contacts are opened. When one stops depressing the key 11, it comes back to its rest position and the contacts are again closed.

It will be understood that the contacts thus formed by the superimposition of the three sheets 16, 32 and 34 are perfectly tight and remain tight for the whole time of use of the keyboard.

Figure 4:
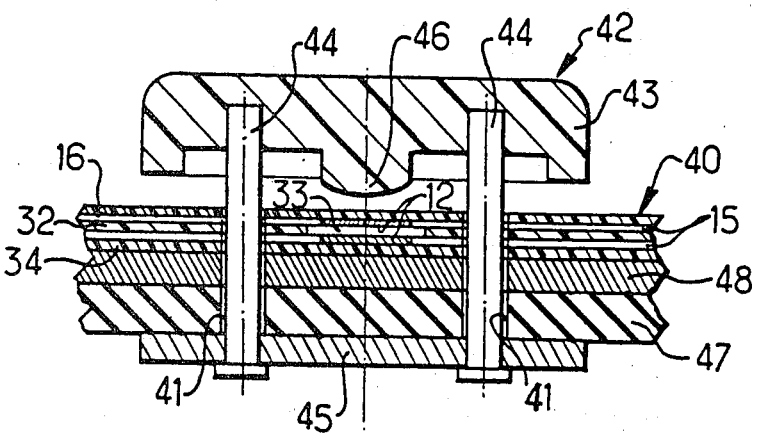
FIG. 4 is a partial sectional diagrammatic view of a third embodiment of a keyboard according to the invention, with tight contacts normally open in the rest position.

The embodiment shown in FIG. 4 corresponds substantially to that of FIG. 2 and 3, and differs therefrom only in that the contacts, controlled by the keys, are normally open in the rest position of the keys.

In the embodiment of FIG. 4 the composite plate 40, or grid, is formed with two narrow holes 41 for each key, and each key 42 comprises a head 43 mounted, in an appropriate manner, on the upper end of two parallel stems 44 extending freely through the holes 41. At their lower end, the two stems 44 are rigidly connected to a plate or washer 45 made of soft iron or any other similar and appropriate material.

As previously, the composite plate or grid 40 comprises a thin metallic plate 48 on the lower face of which is fixed a plate 47 made of a magnetic material, for example a multipolar magnetic elastomer.

An assembly of thin sheets 16, 32 and 34, exactly similar to that shown in FIG. 2 and 3, is fixed or placed on the upper face of the metallic plate 48, the lower thin sheet 34, being for example, fixed on the metallic plate 48.

In the example shown in FIG. 4, two contact wafers 12 carried by the sheets 16 and 34 respectively, are between the two stems 44 of key 42, and the head 43 of the latter comprises, on its lower face, a stud or finger 46 protruding downwardly and provided on the vertical of the wafers 12.

When the user depresses the key 42 for displacing it from its rest position shown in FIG. 4 to its working position, the stud or finger 46 comes to bear against the upper thin sheet 16 and brings the contact wafer 12 carried by the sheet 16 in contact with the wafer 12 carried by the lower sheet 34. When the user stops depressing the key 42, the magnetic attraction force exerted by the elastomer plate 47 on the soft iron plate or washer 45 brings the key 42 back to its rest position, so that the stud or finger 46 is drawn away from the upper thin sheet 16, and the latter recovers, by its resiliency, its normal position shown in FIG. 4 wherein the two contact wafers 12 are apart from each other.

It will be understood that in this embodiment, the assembly of the three thin sheets 16, 32 and 34, which are mounted on the upper face of the metallic plate 48, can be protected against outer impacts by a grid, not shown in the drawing, surrounding the heads 43 of keys 42, and forming the front face of the keyboard.

Figure 5:
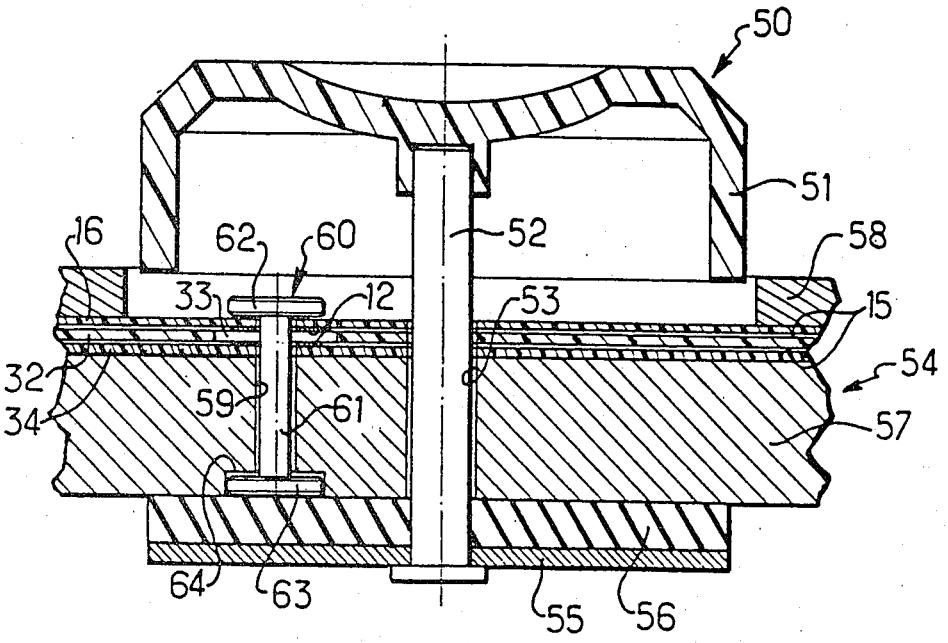
FIG. 5 is a partly sectional diagrammatic view of a fourth embodiment of a keyboard according to the invention, with tight contacts normally open.

The alternative embodiment shown in FIG. 5 relates also to a keyboard with contacts normally open in the rest position of the keys, wherein the duration of the signal obtained when closing the normally open contacts is only slightly less than the total duration of the operation of the key.

In this embodiment, each key 50 comprises a head 51 mounted, in an appropriate manner, on the upper end of a stem 52 which extends freely through a hole 53 of a composite plate 54, and which is rigidly connected, at its lower end, to a plate or washer 55 of soft iron or any other appropriate and similar material, carrying an upper plate 56 made of a magnetic material such as a multipolar magnetic elastomer.

The composite plate 54 comprises a metallic plate 57, on the upper face of which is fixed an assembly of three thin sheets 16, 32 and 34 exactly similar to that shown in FIG. 4. On the upper thin sheet 16 of this assembly is placed or fixed a metallic grid 58 forming the front face of the keyboard and which is formed with openings having a dimension corresponding substantially to that of the head 51 of key 50.

The embodiment of FIG. 5 differs from that of FIG. 4 in that a hole 59, of relatively small diameter, is formed through the metallic plate 57 and the assembly of the three thin sheets 16, 32 and 34, at the level of the contact wafers 12 carried by the sheets 16 and 34. A free piston 60 comprising an axial stem 61, a head 62 and a foot 63, is mounted in said hole 59 so that the head 62 bears against the upper thin sheet 16, without exerting a pressure on said sheet, when the key is in its rest position, the foot 63 of the free piston 60 being housed in a recess 64 formed to this effect in the metallic plate 57. The length of the stem 61 is such that, in this position, the foot 63, which is made of a material such as soft iron, is applied by magnetic attraction on the upper face of the magnetic elastomer plate 56.

The operation of this embodiment is the following:

As soon as the user exerts a pressure on the key 50, and when said key leaves its rest position shown in the drawing, the magnetic elastomer plate 56 which is integral with lower end of stem 52 of the key draws away from the plate 57. The magnetic attraction force exterted by said plate 56 on the foot 63 of the free piston 60 is well in excess of the force which it is necessary to exert on the upper thin sheet 16 for deforming it and bringing its wafer 12 in contact with the corresponding wafer 12 carried by the lower thin sheet 34. Thus, as soon as the key 50 is depressed and leaves its rest position, the free piston 60 follows the movement of said key until the wafer 12 of the upper sheet 16 is brought in contact with the wafer 12 of the lower sheet 34. The free piston 60 is then blocked and cannot move down any further. It remains in this position until the key 50 is back to its initial position.

It will be understood that in this embodiment, the duration of the signal produced by closing the contact is substantially equal or very slightly lower than the total operation time of the key 50.

One understands that in all the embodiments just described, the keyboard has a monolithic structure, viz. the composite grid comprising the holes through which extend the keys, and the plate or sheets carrying the contacts which are adapted for being operated by the keys, form a single unit assembly thereby substantially simplifying the manufacture of said keyboards and reducing their cost considerably.

It is noted also that in the embodiments described, the metallic plates 13, 40 and 57 have a double function; they serve as reinforcement element providing the composite plate thus obtained with rigidity, and they are always situated just above the magnetic elastomer plates 14, 47 and 56, which provides the possibility of cancelling the magnetic field above said plates, and to reinforce it quite considerably below said plates.

Finally, one will remark that the magnetic return forces exerted on the keys for bringing them back to their rest position and keeping them in their rest position are always far superior to the weight of the keys, so that the keyboard according to the invention can resist important accelerations and vibrations. One should also note that the embodiments of the keyboard according to the invention, shown in FIGS. 2, 4 and 5, have been subjected to very severe tests. Said tests have allowed establishing that after $10^8$ manipulations, said keyboards do not exhibit any deterioration or fatigue sign.

The invention is of course not limited to the embodiments described and shown and which were given only by way of examples. In particular, it comprises all the means forming technical equivalents of the described means, as well as their combinations, provided the latter are carried out according to its spirit.

What is claimed is:

1. A keyboard comprising a layered composite plate made from a layer of magnetic material and an electric printed circuit made on an insulating substrate applied on a lower face of said layer of magnetic material, said plate being formed with holes extending through the layer of magnetic material and the substrate of the electric printed circuit, said keyboard further comprising keys having stems extending through said holes, key tops mounted on the stems and soft iron plates mounted on the stems opposite to said key tops and extending under said composite plate, said soft iron plates being magnetically attracted by said layer of magnetic material and defining a rest position of the keys when applied onto said plate, said soft iron plates further cooperating with conductive contact areas of the electric printed circuit for forming switches which are closed when the keys are in their rest position and opened as soon as the keys leave their rest position.

2. A keyboard according to claim 1, wherein the said soft iron plates are formed with protrusions cooperating with the said contact areas of the printed circuit for closing said switches when the keys are in their rest position.

3. A keyboard according to claim 1, wherein the contact areas of said printed circuit and the soft iron plates of the keys are electrically connected to each other when the keys are in their rest position.

4. A keyboard according to claim 1, wherein said composite plate further comprises a layer of insulating material fixed on said printed circuit and a second printed circuit formed on a face of an electrically insulating flexible sheet which is fixed by said face on the said layer of insulating material, said second printed circuit having contact areas disposed in register to the contact areas of the first cited printed circuit, and the layer of insulating material having cut-outs at the level of said contact areas, so that two contact areas in register can be brought into contact with each other by a said soft iron plate of a key when the key is in its rest position.

5. A keyboard according to claim 1, wherein the composite plate comprises an upper metallic plate covering said layer of magnetic material.

6. A keyboard comprising a layered composite plate made from a layer of magnetic material and an electric printed circuit formed on an insulating substrate applied on an upper face of the composite plate, said composite plate being formed with holes extending through the said substrate and said layer of magnetic material, said keyboard further comprising keys having key stems extending through said holes, key tops mounted on the stems and soft iron plates mounted on the stems opposite said key tops and extending under said composite plate, said soft iron plates being magnetically attracted by said layer of magnetic material and defining, when applied on said composite plate, a rest position of the keys, said composite plate further comprising an intermediate sheet of insulating material covering said printed circuit, and an upper insulating flexible sheet fixed by a face on said intermediate sheet and provided on said face with an electric printed circuit, both printed circuits having conductive contact areas in register to one another and the intermediate sheet having cut-outs at the level of said contact areas, the key tops having protrusions extending downwardly and adapted for applying the contact areas of the printed circuits on each other when the keys are brought to a working position.

7. A keyboard according to claim 6, wherein a metallic plate having holes is disposed between the layer of magnetic material and the said insulating substrate.

8. A keyboard comprising a layered composite plate including a metallic plate, a first insulating substrate formed with an electric printed circuit and fixed on an upper face of the metallic plate, an insulating sheet fixed on said substrate and covering the printed circuit, a second insulating substrate fixed by a face on said insulating sheet and provided on said face with an electric printed circuit, both printed circuits having contact areas disposed in register to one another and said insulating sheet having cut-outs at the level of said contact areas, the said composite plate being formed with holes extending through said metallic plate, said first and second substrates and said insulating sheet, said keyboard further comprising keys having key stems extending through said holes, key tops mounted on the stems and plates of magnetic material mounted on the stems opposite the key tops and disposed under said composite plate, said plates of magnetic material being magnetically attracted towards said composite plate and defining, when applied on said plate, the rest position of the keys, said composite plate being further provided with holes into which are disposed free pistons each having a head which bears on the second insulating substrate at the level of said contact areas and each having a foot magnetically attracted by the plates of magnetic material on the key stems, said contact areas of both printed circuits being applied on each other by the free piston heads as seen as the keys leave their rest position.

9. A keyboard according to claim 8, wherein an upper metallic plate having holes covers the said second insulating substrate on said composite plate.

* * * * *